United States Patent [19]

Dlugokecki et al.

[11] Patent Number: 4,699,577

[45] Date of Patent: Oct. 13, 1987

[54] INTERNAL GEAR DEVICE WITH IMPROVED ROTARY VALVE

[75] Inventors: Andrew N. Dlugokecki, Bridgton; Carle A. Middlekauff, Cumberland Center, both of Me.

[73] Assignee: Parker Hannifin Corporation, Cleveland, Ohio

[21] Appl. No.: 860,715

[22] Filed: May 6, 1986

[51] Int. Cl.[4] ..... F03C 2/08; F04C 2/113; F04C 15/00

[52] U.S. Cl. ..... 418/61 B; 418/75; 418/77; 137/625.21

[58] Field of Search ..... 418/61 B, 75, 77, 79; 137/625.21; 251/283

[56] References Cited

U.S. PATENT DOCUMENTS

| | | | |
|---|---|---|---|
| 3,572,983 | 3/1971 | McDermott | 418/61 B |
| 4,281,684 | 8/1981 | Broeg | 137/625.21 |
| 4,411,607 | 10/1983 | Wusthof et al. | 418/61 B |
| 4,545,748 | 10/1985 | Middlekauff | 418/61 B |

*Primary Examiner*—John J. Vrablik

*Attorney, Agent, or Firm*—Christopher H. Morgan

[57] ABSTRACT

A gerotor device wherein a body (10) includes high pressure ports (20) that communicate with an inlet (12) and low pressure ports (22) that communicate with an outlet (14). An inner member (42) and an outer member (40) cooperate to define pressure chambers (52) that increase and decrease in volume as the member (42) orbits and rotates. A rotary valve (62) selectively connects pressure chambers (52) to pressure ports (20) and (22) to convert between mechanical torque and fluid pressure. Cavities (75) and (77) are provided adjacent rotary valve (62) to hydraulically balance the valve.

22 Claims, 7 Drawing Figures

FIG. 2
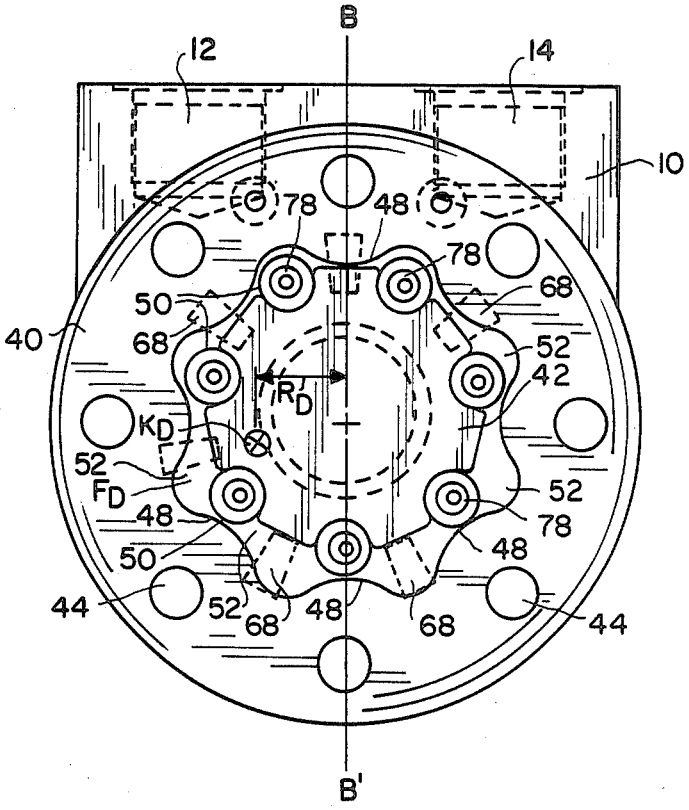
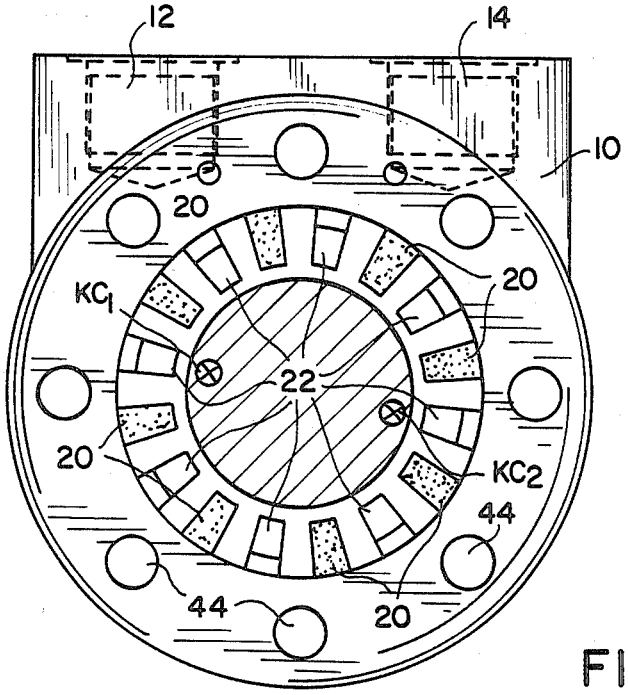
FIG. 3

INTERNAL GEAR DEVICE WITH IMPROVED ROTARY VALVE

BACKGROUND OF THE INVENTION

1. Field of the Invention

The subject invention is generally directed to gerotor hydraulic devices that can be used as pumps and motors and, more specifically, to hydraulic balancing of moving parts in such devices.

2. Description of the Prior Art

Many types of prior art hydraulic devices have incorporated gerotor, or internal gear sets. Such devices have been used and described as both pumps and motors. Examples are shown in U.S. Pat. Nos. 3,572,983; 4,411,607; and 4,545,748. Briefly, an internal gear having outwardly directed teeth cooperates with either an external gear having inwardly directed teeth or, alternatively, an external ring that is maintained in an outer housing. The internal gear and external gear or ring defined fluid chambers. The internal gear and external gear or ring have a different number of teeth and are sized such that the fluid chambers expand and contract as the gears rotate. Thus, a basis for conversion between fluid pressure and mechanical torque is provided.

In such gerotor devices, as in other hydraulic devices, it is important that moving components be hydraulically balanced. Unbalanced components are subject to excessive friction and asymmetrical movement. Excessive friction accelerates mechanical wear and shortens the useful life of the device. Asymmetrical movement such as tilting, eccentricity, or skewing increases hydraulic leakage and friction which reduces mechanical efficiency and comprises the operating efficiency of the device.

As with other types of hydraulic devices, gerotor, or internal gear, pumps and motors require hydraulic balancing to achieve high efficiency and to realize their useful working life. To attain good performance, internal gear devices generally use a type of rotary face valve that employs lapped surfaces to effect tightly controlled clearances. However, the tight clearance of such rotary valves demands that the rotary valve be hydraulically balanced.

In the prior art, the rotary valve was usually balanced through the use of a fixed plate that separated the displacement element from the rotary valve. One example of such a fixed plate is shown and described in U.S. Pat. No. 3,572,983. In that patent, the hydraulic force generated by the chambers on one half of the displacement element is absorbed by one side of the fixed plate. The opposite side of the fixed plate absorbs the hydraulic forces developed by the high pressure ports of the rotary valve. Pressure areas are also provided on the valve side of the fixed plate to accomplish additional hydraulic balancing of the valve.

Other types of gerotor devices that employ a rotary valve have eliminated the need for a stationary plate. An example of a gerotor device having such a rotary valve is shown in U.S. Pat. No. 4,545,748. However, in rotary valve type gerotor devices without the fixed plate mentioned above, the rotary valve is subject to the hydraulic forces from both the displacement element chambers and the high pressure commutator ports. These forces place the rotary valve in a condition of hydraulic imbalance. Accordingly, compensation for the hydraulic forces acting on the rotary valve have been found to improve the efficiency and extend the operational life of the device.

A technique for partial balancing of the rotary valve in a gerotor device is shown in U.S. Pat. No. 4,411,607. In that patent, recessed sections and grooves are provided in the rotary valve face that is adjacent the commutator ports. The recessed sections and grooves are said to be arranged so that they develop a counterforce that opposes the force exerted on the rotary valve by the displacement element chambers. However, in the prior art, there was no mechanism for counterbalancing the force on the rotary valve from the high pressure commutator ports.

Accordingly, there was a need in the prior art for a mechanism to more completely hydraulically balance the rotary valves in gerotor devices. In addition, it was recognized that more complete balancing of other moving components in the gerotor device would further improve efficiency and performance.

SUMMARY OF THE INVENTION

In accordance with the subject invention, a gerotor type hydraulic device includes a body that has a fluid inlet and a fluid outlet. The body also includes a commutator face that has a plurality of high pressure ports that communicate with the fluid inlet and a plurality of low pressure ports that communicate with the fluid outlet. A displacement gear set that includes an outer member and an inner member has one side that is connected to the body. The inner member is located radially inwardly of the outer member such that the inner member and the outer member cooperate to define a plurality of fluid chambers. A shaft is coupled to the inner member of the gear set and is rotatable therewith. Also, a valve plate is located between the gear set and the pressure ports of the body. The valve plate is connected to the shaft and rotates therewith. The valve plate cooperates with the displacement gear set to define at least one balancing cavity therebetween. Also, the valve plate includes a plurality of windows and a plurality of through holes. The windows are regularly spaced in a substantially circular array and the through holes are located at substantially regular angular positions between the windows. The through holes form passageways between the pressure ports of the body and the balancing cavity defined between the gear set and the valve plate.

Preferably, the balancing cavity defined by the gear set and the valve plate is located either between the valve plate and the outer gear member or between the valve plate and the inner gear member. Alternatively, balancing cavities can be defined between the valve plate and both the outer and inner gear members.

More preferably, the balancing cavity between the valve plate and the gear set is defined by a recessed area in the valve plate that cooperates with the outer gear, or a recessed area in the inner gear that cooperates with the valve plate.

Most preferably, the device further includes a cover that is located on the side of the gear set that is oppositely disposed from the body. The inner member cooperates with the cover to define at least one counterbalancing cavity. The inner member also includes at least one bore that provides fluid communication between the counterbalancing cavity and the balancing cavity defined by the valve plate and the gear set.

Other details, objects and advantages of the invention will become apparent as the following description of a presently preferred embodiment proceeds.

BRIEF DESCRIPTION OF THE DRAWINGS

The accompanying drawings show a presently preferred embodiment of the subject invention in which:

FIG. 2 is a cross section of the embodiment of FIG. 1 taken along the lines II—II and showing the inner and outer gears of the displacement element.

FIG. 3 is a cross section of the embodiment of FIG. 1 taken along the lines III—III and showing the commutator ports in the body.

DESCRIPTION OF THE PREFERRED EMBODIMENT

Figure 1:
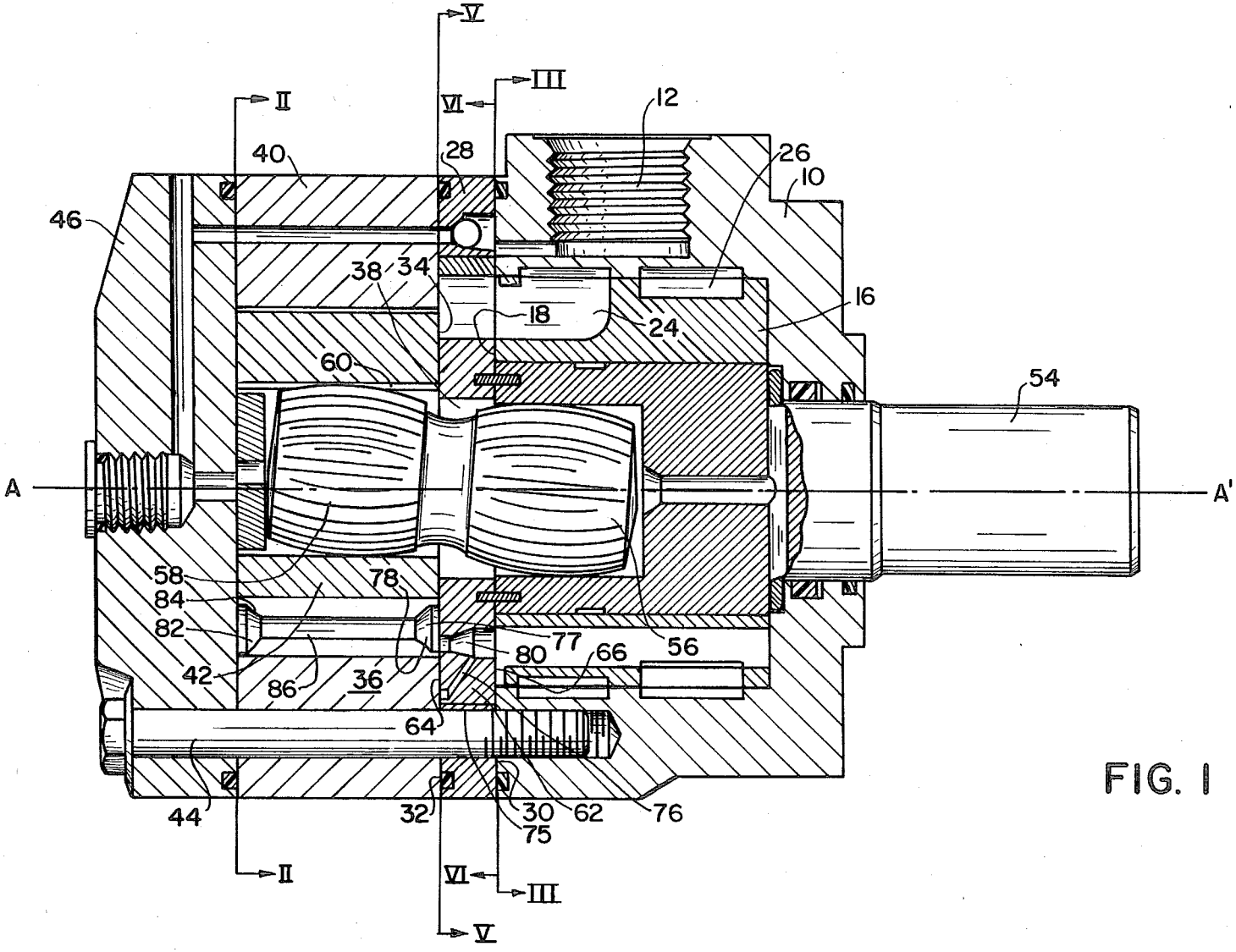
FIG. 1 is a cross sectional view of the presently preferred embodiment taken along the axis of rotation A—A'.

The fundamental operation of the gerotor shown in FIGS. 1, 2 and 3 is known in the art and has been described in U.S. Pat. No. 4,545,748. U.S. Pat. No. 4,545,748 has been assigned to the same assignee as the subject invention and is hereby specifically incorporated by reference. Briefly, referring particularly to FIGS. 1 and 3, a body 10 is provided with an inlet 12 and an outlet 14. Body 10 also includes a commutator 16 having a face surface 18. As shown in FIG. 3, face surface 18 includes a plurality of high pressure ports 20 and a plurality of low pressure ports 22. High pressure ports 20 and low pressure ports 22 are arranged in a substantially regular circular array with high pressure ports 20 being alternatively located between low pressure ports 22.

Commutator 16 defines a plurality of high pressure passageways 24 that respectively communicate between one of the high pressure ports 20 and the inlet 12. Commutator 16 also defines a plurality of low pressure passageways 26 that respectively communicate between one of the low pressure ports 22 and the outlet 14.

A valve spacer 28 has one face 30 that opposes the commutator face 18 of body 10. The opposite face 32 of spacer 28 opposes a face 34 of a displacement gear set 36 such that commutator face 18 of body 10, valve spacer 28 and gear set 36 cooperate to define a chamber 38.

Displacement gear set 36 can be any of various gerotor type displacement gear sets wherein an internal member has radially outwardly directed teeth and an outer member has a different number of radially inwardly directed teeth. The relative number and arrangement of the teeth are such that rotation of one of the members causes orbital motion of the other of said members. The inner member may rotate on a shaft in conjunction with an outer member that orbits, or the inner member can orbit with the outer member remaining stationary. In any case, the members cooperate to define pressure chambers therebetween that expand and contract as theinner and outer members are rotated.

In the example of the preferred embodiment, displacement gear set 36 includes an outer member 40 and an inner member 42. Bolts 44 secure outer member 40 between face 32 of valve spacer 28 and a cover 46. As best shown in FIG. 2, outer member 40 includes a number of radially inwardly directed teeth 48 and inner member 42 is provided with a number of radially outwardly directed teeth formed by rollers 50. The number of rollers 50 is one less than the number of inward teeth 48 and the radial clearances provided between outer member 40 and inner member 42 are such that a plurality of pressure chambers 52 are defined between outer member 40, inner member 42 and cover 46. Rotation of inner member 42 causes it to orbit the inside of outer member 40 and causes pressure chambers 52 to expand and contract accordingly. Thus, outer member 40 and inner member 42 of gear set 36 provide the basis for conversion between hydraulic pressure and mechanical torque.

A shaft 54 is rotatably mounted in body 10 and includes a dog-bone portion 56 at one end. Dog-bone 56 has splines 58 that cooperate with splines 60 that are located on the inner radius of inner member 42 so that inner member 42 rotates together with dog-bone 56. Dog-bone 56 is splined to the main portion of shaft 54 such that it provides a universal type connection between inner member 42 and shaft 54 that accommodates the orbital motion of inner member 42.

Figure 5:
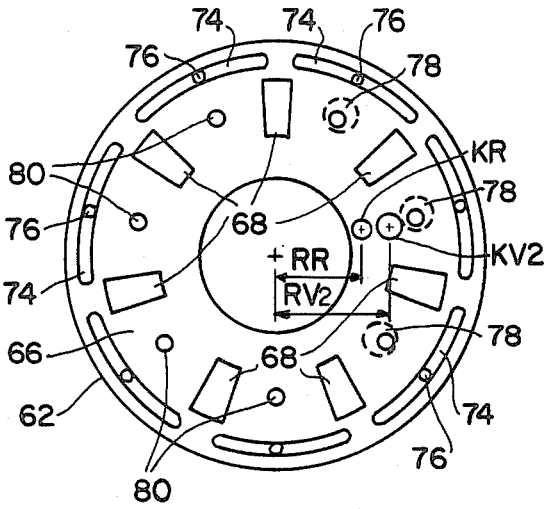
FIG. 5 is a view of the rotary valve shown in FIGS. 1 and 4 taken along the lines V—V of FIG. 1 and showing the face of the rotary valve that is adjacent the displacement element.
Figure 4:
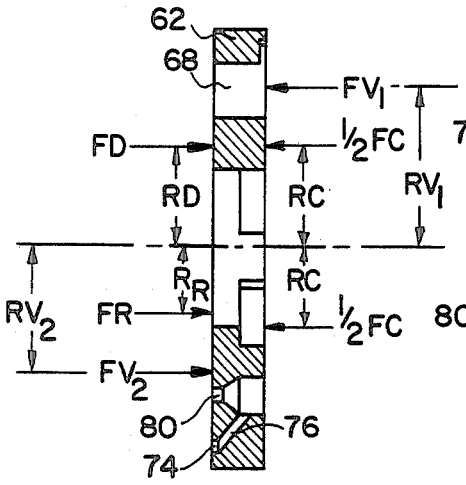
FIG. 4 is a cross section of the rotary valve of FIG. 1 shown in isolation and illustrating various hydraulic forces acting on the valve.
Figure 6:
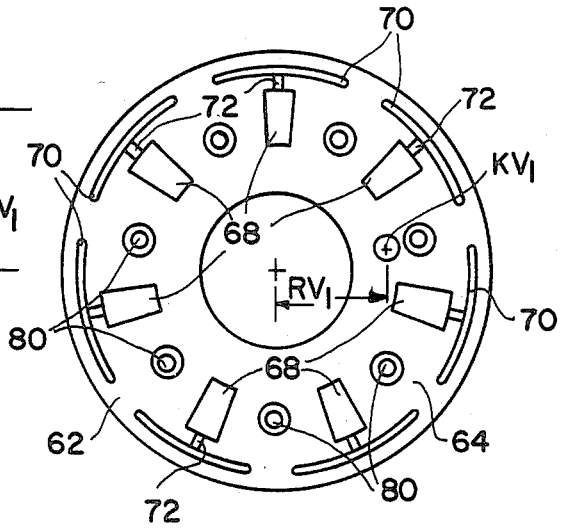
FIG. 6 is a view of the rotary valve shown in FIGS. 1 and 4 taken along the lines VI—VI of FIG. 2 and showing the face of the rotary valve that is adjacent the commutator face of the body.

A rotary valve 62 is located in chamber 38 and is secured to shaft 54 such that it is rotatable therewith. As best shown in FIGS. 4–6, valve plate 62 has an element face 64 that is located adjacent the gear set 36, and a body face 66 that is located adjacent the commutator face 18 of body 10.

Valve plate 62 is further provided with a plurality of windows 68 that selectively communicate between the pressure ports 20 and 22 in commutator face surface 18 and pressure chambers 52 in gear set 36. Windows 68 are regularly spaced in a substantially circular array. Referring particularly to the dotted areas in FIG. 2, windows 68 provide fluid communication between the high pressure ports 20 on one half of the circular array of ports in commutator face 18, and the pressure chambers 52 that are adjacent element face 64 and oppositely disposed in chamber 38 from ports 20. At the same time, windows 68 provide fluid communication between the low pressure ports 22 on the opposite half of the circular array of ports in commutator face 18, and the pressure chambers 52 that are adjacent element face 64 and oppositely disposed in chamber 38 from ports 22. In this way, inlet fluid pressure is selectively provided to pressure chambers 52 on one half of the gear set to cause them to expand, and a fluid drain is provided to pressure chambers 52 on the other half of the gear set to permit the pressure chambers to contract. As shaft 54 rotates, rotary valve 62 will appropriately connect and disconnect the pressure chambers 52 to pressure or to drain as required for continuous rotation of shaft 54.

As illustrated in FIGS. 2 and 4, valve plate 62 is exposed to various fluid forces that tend to cause plate 62 to become hydraulically unbalanced. As illustrated in FIG. 2, pressure chambers 52 to the left of ordinate axis B—B' are at high pressure. The force from the high pressure chambers 52 is equivalent of the force FD acting at the centroid KD of the area. KD is located at a radius RD from the rotary axis A—A' of shaft 54. Force FD acts in one direction against external member 42 and cover 46 which are stationary and, as illustrated in FIG. 4, in the opposite direction against rotary valve 62.

A second force that acts against rotary valve 62 is developed by high pressure ports 20 in commutator face 18. As illustrated by the dotted areas in FIG. 3, high pressure ports 20 generate a force that is equivalent to force FC located at the centerline of the shaft. The force FC is equivalent to the two force components FC1 and FC2 which act at locations KC1 and KC2. Each of forces FC1 and FC2 is substantially equal to one half the total force FC. These forces act in one direction against stationary commutator 16 and, in the opposite direction, against rotary valve 62. The force against rotary valve 62 is partly translated through displacement gear set 36 to cover 46.

The forces FD, FC1 and FC2 acting on rotary valve 62 are illustrated in FIG. 4. As shown in FIGS. 4 and 6, rotary valve 62 is provided with a plurality of circumferential recesses 70 that are in fluid communication with a respective one of the windows 68 through a plurality of grooves 72. When circumferential grooves 70 and grooves 72 are in communication with high pressure ports 20, a balancing force FV1 acting against rotary valve 62 at point KV1 and radius KV1 is developed. As best shown in FIG. 4, force FV1 substantially balances the force FD to help avoid asymmetrical motion of valve plate 62.

However, when force FV1, in combination with FC1, counteracts force FD, they also add to the force FC2 which is developed due to hydraulic pressure from high pressure ports 20. Thus, force FV1 actually adds to the axial imbalance of rotary valve 62, and forces rotary valve 62 more heavily into gear set 36. This tends to increase friction both between rotary valve 62 and gear set 36, and between gear set 36 and cover 46.

To balance forces FC1, FC2 and FV1, rotary valve 62 and displacement gear set 36 of the presently preferred embodiment cooperate to define at least one balancing cavity therebetween. More specifically shown in FIG. 5, rotary valve 62 includes a recessed area 74 that cooperates with the outer member 40 to define a balancing cavity 75. Rotary valve 62 further includes a plurality of through holes 76 that are respectively located at substantially regular angular positions equidistant between windows 68. Through holes 76 form respective passageways between high pressure ports 20 and recessed areas 74.

In addition, other balancing cavities 77 defined by gear set 36 and rotary valve 62 are located between rotary valve 62 and inner member 42. Specifically, the rollers 50 of inner member 42 are provided with recessed areas 78 and rotary valve 62 is provided with a plurality of through holes 80 that are respectively located at substantially regular angular positions equidistant between windows 68. Holes 80 form respective passageways between high pressure ports 20 and balancing cavities 77.

Since through holes 76 and 80 are equidistant between windows 68, they carry high pressure fluid from high pressure ports 20 at a phase angle of 180 degrees with respect to high pressure in pressure chambers 52. High pressure provided to cavities 75 from ports 20 and holes 76 develops a force FV2 that equivalently acts at points KV2 against stationary outer member 40 and against rotary valve 62. The size of recessed area 74 is selected such that the force FV2 applied against rotary valve 62 balances the opposing force FC2 resulting from the high pressure ports 20.

Alternatively, or in combination with cavities 75, cavities 77 also provide balancing against force FC2. Specifically, high pressure from ports 20 operates through holes 80 to develop a force FR that acts against rollers 50 and rotary valve 62. Force FR equivalently acts at point KR and radius RR. The size of recessed area 78 is selected such that the force FR, either alone or in combination with the force FV2 balances rotary valve 62 against force FC.

Where cavity 77 is used to balance force FV2, the force FR, which also acts against gear set 36, should be counterbalanced. Specifically, the force FR acts against rollers 50 and tends to urge them into contact with cover 46. This force is balanced by providing at least one counterbalancing chamber 82 defined by cover 46 and rollers 50. Specifically, the ends of rollers 50 opposite from rotary valve 62 are provided with recessed areas 84. Rollers 50 are further provided with passageways 86 that respectively communicate between balancing cavities 77 and counterbalancing chambers 82.

The size of recessed area 84 is selected to be approximately the same size as recessed areas 78. High pressure provided to cavity 77 travels through passageways 86 to chamber 82. Since recessed areas 78 and 84 are of substantially the same area, the forces acting against opposite ends of rollers 50 are balanced.

Figure 7:
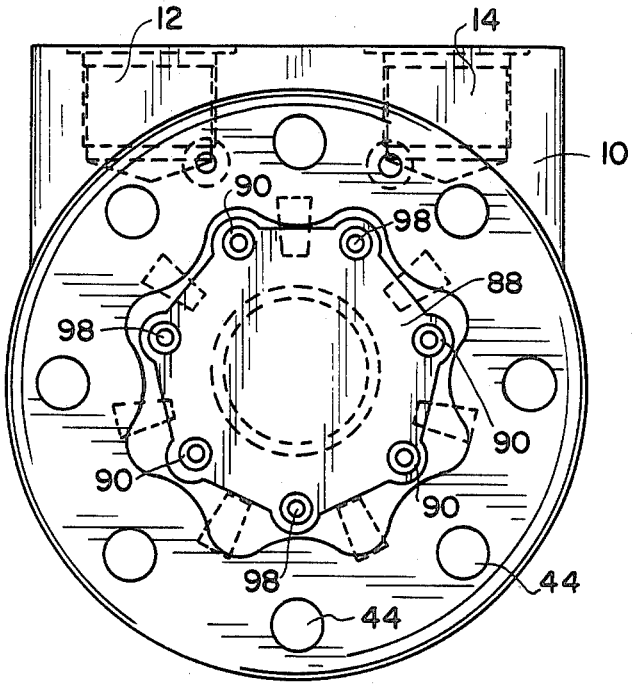
FIG. 7 is a cross section of a displacement element similar to that of FIG. 2 except that the teeth of the internal gear are made an integral part thereof.

FIG. 7 shows an alternative embodiment of the subject invention wherein the teeth of inner member 88 are made an integral part of the inner member. In this case, inner member 88 should still be balanced against the forces acting against it from cavity 77. Accordingly, inner member 88 is provided with recessed areas 90 that cooperate with rotary valve 62 to form balancing cavities, and recessed areas that cooperate with cover 46 to form counterbalancing chambers. Inner member 88 is further provided with passageways 98 that communicate between the balancing cavities and the counterbalancing chamber. High pressure provided to the balancing cavities is thus communicated to the counterbalancing chambers such that inner member 88 is balanced.

While certain presently preferred embodiments of the subject invention have been shown and described herein, the invention is not limited thereto but can be otherwise variously embodied within the scope of the following claims.

We claim:

1. A hydraulic device comprising:

a body having a fluid inlet, a fluid outlet, and a commutator face, said commutator face having a plurality of high pressure ports that are in communication with said fluid inlet and a plurality of low pressure ports that are in communication with said fluid outlet;

a displacement gear set connected to said body and having an outer member and having an inner member that is located radially inwardly of said outer member, said inner and outer members cooperating to define a plurality of fluid chambers;

a shaft that is coupled to the inner member of said gear set and that is rotatable therewith; and a rotary valve that is located between the gear set and the commutator face of said body, and that is connected to said shaft and rotatable therewith, said valve plate cooperating with said displacement gear set to define at least one balancing cavity therebetween, said valve plate having, a plurality of windows that are regularly spaced in a substantially circular array for providing fluid communication between said high and low pressure ports and said fluid chambers; and a plurality of through holes that are respectively located at substantially regular angular positions between said windows, said holes forming respective passageways between high pressure ports of said body and a balancing means defined by said gear set and said rotary valve.

2. The hydraulic device of claim 1 wherein said balancing means defined by said gear set and said rotary valve is located between said rotary valve and said outer gear member.

3. The hydraulic device of claim 1 wherein said balancing means defined by said gear set and said rotary valve is located between said rotary valve and said inner gear member.

4. The hydraulic device of claim 1 wherein said balancing means defined by said gear set and said rotary valve is located between said rotary valve and said inner gear member, and between said rotary valve and said outer gear member.

5. The hydraulic device of claims 1 or 2 wherein said rotary valve includes a recessed area that cooperates with said outer gear to define said balancing means.

6. The hydraulic device of claims 1 or 3 wherein said inner gear includes a recessed area that cooperates with said rotary valve to define said balancing means.

7. The hydraulic device of claims 1, 2, or 3 wherein said rotary valve includes a recessed area that cooperates with said outer gear to define a balancing cavity and wherein said inner gear includes a recessed area that cooperates with said rotary valve to define said balancing means.

8. A hydraulic device comprising:

a body having a fluid inlet, a fluid outlet, and a commutator face, said commutator face having a plurality of high pressure ports that are in communication with said fluid inlet and a plurality of low pressure ports that are in communication with said fluid outlet;

a displacement gear set connected to said body and having an outer member and having an inner member that is located radially inwardly of said outer member;

a cover that is located on the side of said gear set that is oppositely disposed from said body, said cover cooperating with said inner member and said outer member to define a plurality of fluid chambers;

a shaft that is coupled to the inner member of said gear set and that is rotatable therewith; and a rotary valve that is located between the gear set and the commutator face of said body, and that is connected to said shaft and rotatable therewith, said rotary valve cooperating with said displacement gear set to define at least one balancing cavity therebetween, said valve plate having, a plurality of windows that are regularly spaced in a substantially circular array for providing fluid communication between said high and how pressure ports and said fluid chambers; and a plurality of through holes that are respectively located at substantially regular angular positions between said windows, said holes forming respective passageways between high pressure ports of said body and the balancing cavity defined by said gear set and said rotary valve.

9. The hydraulic device of claim 8 wherein said rotary valve cooperates with said commutator face to define at least one commutator side balancing cavity therebetween.

10. The hydraulic device of claim 9 wherein said rotary valve includes a recessed area that cooperates with said commutator face to define the commutator side balancing cavity.

11. The hydraulic device of claim 8 wherein said inner member cooperates with said cover to define at least one counterbalancing cavity, and wherein said inner member includes at least one bore that provides fluid communication between said counterbalancing cavity and the balancing cavity defined by said valve plate and said gear set.

12. The hydraulic device of claim 11 wherein said inner member includes teeth that are comprised of rollers, and wherein the bores in said inner member are included in said rollers.

13. The hydraulic device of claim 18 wherein the high pressure ports and the low pressure ports of said commutator face are arranged in a substantially regular, circular array with said high pressure ports alternatively located between said low pressure ports.

14. The hydraulic device of claim 9 wherein the windows of said rotary valve provide fluid communication between the high pressure ports located on one half of the substantially circular array of ports in the commutator face, and the fluid chambers that are adjacently located the oppositely disposed side of the rotary valve, and wherein said windows provide fluid communication between the low pressure ports on the other half of the substantially circular array of ports and the fluid chambers that are adjacently located the oppositely disposed side of said rotary valve.

15. The hydraulic device of claim 10 wherein the through holes of said rotary valve are arranged in a substantially circular array.

16. The hydraulic device of claim 8 wherein said shaft includes a universal linkage that permits orbital motion of said inner member with respect to said outer member.

17. The hydraulic device of claims 8, 9, 10, 11, 12, 13, 14, 15 or 16 wherein a balancing cavity defined by said gear set and said rotary valve is located between said rotary valve and said outer gear member.

18. The hydraulic device of claims 8, 9, 10, 11, 12, 13, 14, 15 or 16 wherein a balancing cavity defined by said gear set and said rotary valve is located between said rotary valve and said inner gear member.

19. The hydraulic device of claims 8, 9, 10, 11, 12, 13, 14, 15 or 16 wherein a balancing cavity defined by said gear set and said rotary valve is located between said rotary valve and said inner gear member, and between said rotary valve and said outer gear member.

20. The hydraulic device of claims 8, 9, 10, 11, 12, 13, 14, 15 or 16 wherein said rotary valve includes a recessed area that cooperates with said outer gear to define a balancing cavity.

21. The hydraulic device of claims 8, 9, 10, 11, 12, 13, 14, 15 or 16 wherein said inner gear includes a recessed area that cooperates with said rotary valve to define a balancing cavity.

22. The hydraulic device of claims 8, 9, 10, 11, 12, 13, 14, 15 or 16 wherein said rotary valve includes a recessed area that cooperates with said outer gear to define a balancing cavity and wherein said inner gear includes a recessed area that cooperates with said rotary valve to define a balancing cavity.

* * * * *

UNITED STATES PATENT AND TRADEMARK OFFICE

CERTIFICATE OF CORRECTION

PATENT NO. : 4,699,577

DATED : October 13, 1987

INVENTOR(S) : Andrew N. Dlugokecki et al

It is certified that error appears in the above-identified patent and that said Letters Patent is hereby corrected as shown below:

In Claim No. 13, Column 8, line 21, "Claim 18" should read -- Claim 8 --.

Signed and Sealed this

Twenty-second Day of November, 1988

*Attest:*

DONALD J. QUIGG

*Attesting Officer*

*Commissioner of Patents and Trademarks*